US006846148B2

(12) United States Patent
Riba Romeva et al.

(10) Patent No.: US 6,846,148 B2
(45) Date of Patent: Jan. 25, 2005

(54) DEVICE FOR PICKING UP AND DUMPING OR WASHING GARBAGE CONTAINERS ON TRUCKS

(75) Inventors: Carles Riba Romeva, Barcelona (ES); Carlos Domenech Mestres, Barcelona (ES); Prudencio Laliena Jalle, Tarrega (ES); Domingo Casellas Sole, Tarrega (ES); Ramon Roca Enrich, Tarrega (ES)

(73) Assignee: Ros Roca, S.A., Tarrega (ES)

( * ) Notice: Subject to any disclaimer, the term of this patent is extended or adjusted under 35 U.S.C. 154(b) by 0 days.

(21) Appl. No.: 10/279,244

(22) Filed: Oct. 24, 2002

(65) Prior Publication Data

US 2004/0081541 A1 Apr. 29, 2004

(51) Int. Cl.[7] ..... B65B 21/02
(52) U.S. Cl. ..... 414/408; 414/416
(58) Field of Search ..... 414/408, 486

(56) References Cited

U.S. PATENT DOCUMENTS 4,096,959 A * 6/1978 Schaffler ..... 414/408
4,715,767 A * 12/1987 Edelhoff et al. ..... 414/408
5,049,026 A * 9/1991 Bingman et al. ..... 414/408
5,601,392 A * 2/1997 Smith et al. ..... 414/408
5,755,547 A * 5/1998 Flerchinger et al. ..... 414/408

* cited by examiner

*Primary Examiner*—Joe Dillon, Jr.
(74) *Attorney, Agent, or Firm*—Steinberg & Raskin, P.C.

(57) ABSTRACT

This device comprises two U-shaped holders being arranged in an inverted-U arrangement, having their respective rear ends linked in a pin-jointed connection to the truck and having fitted to their front ends a mechanism being provided with supports by means of which the containers are grabbed in order to be lifted and tipped. This device is characterised in that the supports form an assembly being at its lateral, rear region linked in a pin-jointed connection to said mechanism by means of an obliquely diverging appendage. This appendage is linked in a pin-jointed connection to the end of an arm having its other end linked in a pin-jointed connection to a slide being apt to be slid along a guide being provided between the front ends of the U-shaped holders being arranged in an inverted-U arrangement. The arm is a telescopic arm.

9 Claims, 7 Drawing Sheets

DEVICE FOR PICKING UP AND DUMPING OR WASHING GARBAGE CONTAINERS ON TRUCKS

FIELD OF THE INVENTION

A device for picking up and dumping or washing garbage containers on trucks.

BACKGROUND OF THE INVENTION

Several types of refuse and garbage collecting trucks have been known for years, said garbage trucks dumping into their body the contents of containers being distributed along the streets in the cities and built-up areas.

These trucks have been lately arranged so as to laterally carry out the loading operation from behind the cab in order to thus automate the container loading and unloading operations thus no longer requiring the labourers otherwise being needed for the loading and unloading of containers from the back of the truck.

Efforts are being at present devoted to improve the means being used to pick up and dump the containers in order to give the driver a better visibility from inside the cab thus enabling him or her to carry out said operations, and for such a purpose a device has been put into practice by means of which the container is laterally picked up to thereupon be transferred to a position in front of the cab and to be then lifted above the cab in order to then have its contents dumped into the truck body.

These known devices are nevertheless not quite efficient since the driver is forced to step out of the truck in order to turn the container 180° to thus allow its lid to properly open without hampering the dumping of the contents of the container.

It also happens that if the container is properly facing the supports being used to pick it up and dump it but is not arranged in parallel with the truck the driver is also in such a case forced to step out in order to align the container thus allowing it to be picked up.

These problems arising when picking up the containers are also encountered when said containers are picked up in order to be washed on the trucks being arranged for such a purpose.

BRIEF SUMMARY OF THE INVENTION

The device being the object of this invention obviates all of these drawbacks since it can pick up the container irrespective of its location and positioning, and it can even turn the container if necessary.

This new device comprises two U-shaped holders being arranged in an inverted-U arrangement, having their respective rear ends linked in a pin-jointed connection to the truck and having fitted to their front ends a mechanism being provided with supports by means of which the containers are grabbed in order to be lifted and tipped; said device being characterised in that the supports form an assembly having the shape of a horizontal U or fork and being at its lateral, rear region linked in a pin-jointed connection to the mechanism by means of an obliquely diverging appendage being arranged in a plane being at 45° with respect to the extension of the supports, these latter thus having a 270° movability with respect to their pin-jointed connection to said mechanism.

The oblique appendage of the assembly being formed by the supports is linked in a pin-jointed connection to the end of an arm having its other end linked in a pin-jointed connection to a slide being apt to be slid along a guide being provided between the front ends of the U-shaped holders being arranged in an inverted-U arrangement, the pin-jointed connection of said arm being established with one of both ends of the slide, this whole mechanism thus having three degrees of freedom allowing it to act in any position and orientation in the plane where its action is taking place.

The guide is arranged in a tiltable arrangement between the U-shaped holders being arranged in an inverted-U arrangement and comprises two parallel members being arranged one above the other, the slide surrounding the top member and being fitted to the bottom member of the guide.

This device can be folded in front of the cab, and when unfolded it can pick up containers being placed at the right-hand side, at the left-hand side and at the front side irrespective of their positioning. The device can be folded back in two opposite arrangements thus allowing to face the container in accordance with the positioning of its lid. This device does also allow to situate the container grabbing supports at a height being adequate for the container type.

The means being used to grab the containers can be other than those having been mentioned above, such as for example the "diamond" system, or by means of a "comb".

The device being the object of this invention does as well provide for the arm's action to be of a bigger extension, for the slide to be more ruggedly built as regards its operation, and for the containers to be more securely grabbed when being dumped and unloaded.

This is achieved by using a telescopic arm, by forming the slide guides by means of channels cooperating with runners being fitted to the slide, and by providing this latter with sucker pads that will adhere to the walls of the containers.

These and other characteristics will be best made apparent by the following detailed description whose understanding will be made easier by the accompanying seven sheets of drawings showing a practical embodiment cited only by way of example not limiting the scope of the present invention.

DETAILED DESCRIPTION OF PREFERRED EMBODIMENTS

Figure 1:
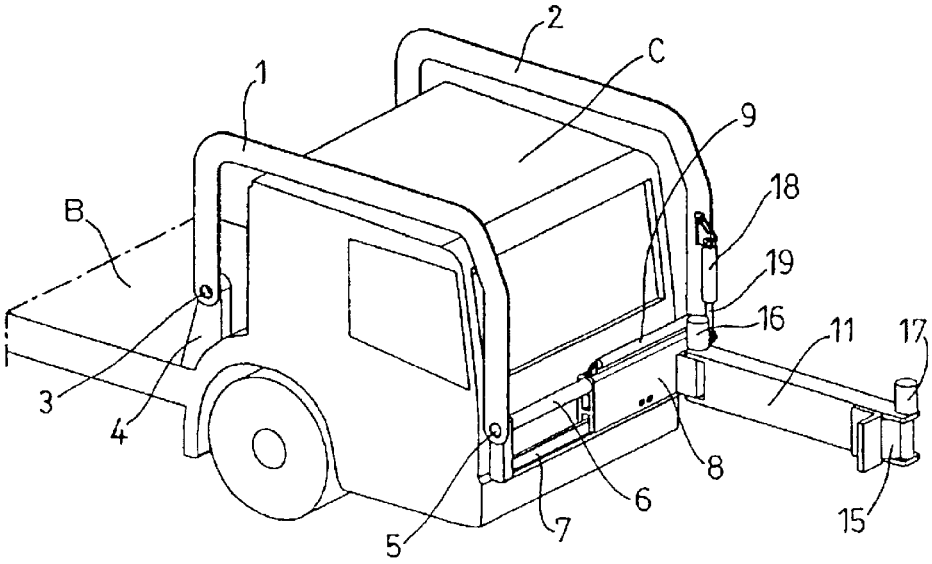
FIGS. 1 and 2 in a perspective view and in a plan-view respectively illustrate this device with the arm being linked in a pin-jointed connection to the left end of the slide and in a normal dumping arrangement with the supports facing the truck's cab.
Figure 2:
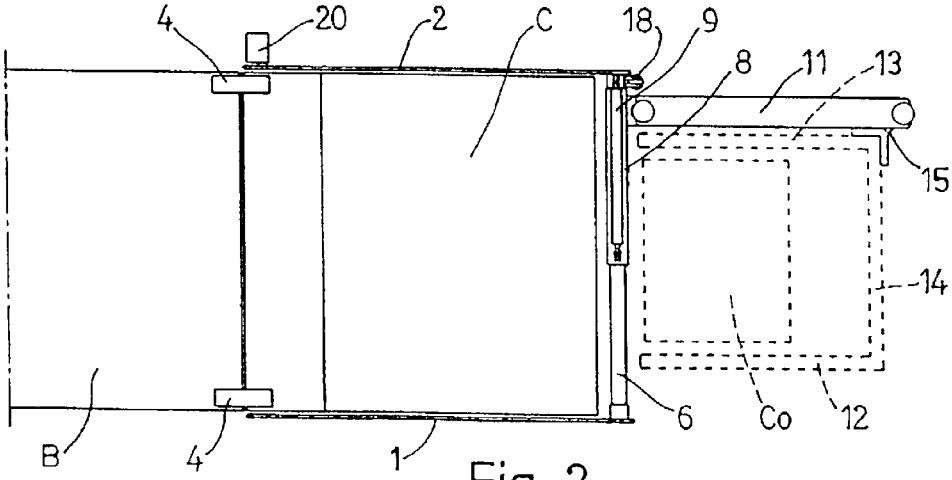
Figure 3:
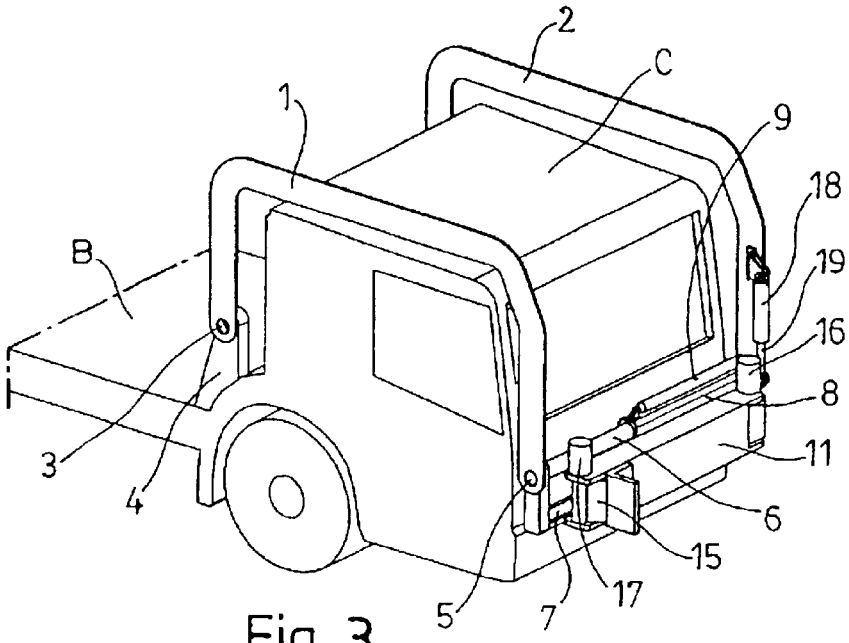
FIGS. 3 and 4 in a perspective view and in a plan-view respectively represent this device being arranged to carry out an inverse dumping operation, with the supports facing away from the cab.
Figure 4:
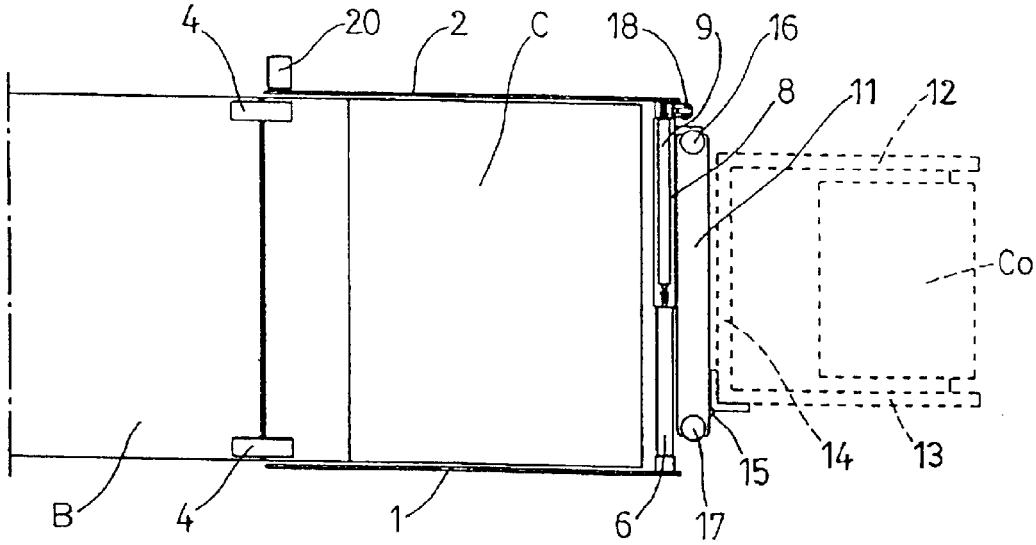
Figure 5:
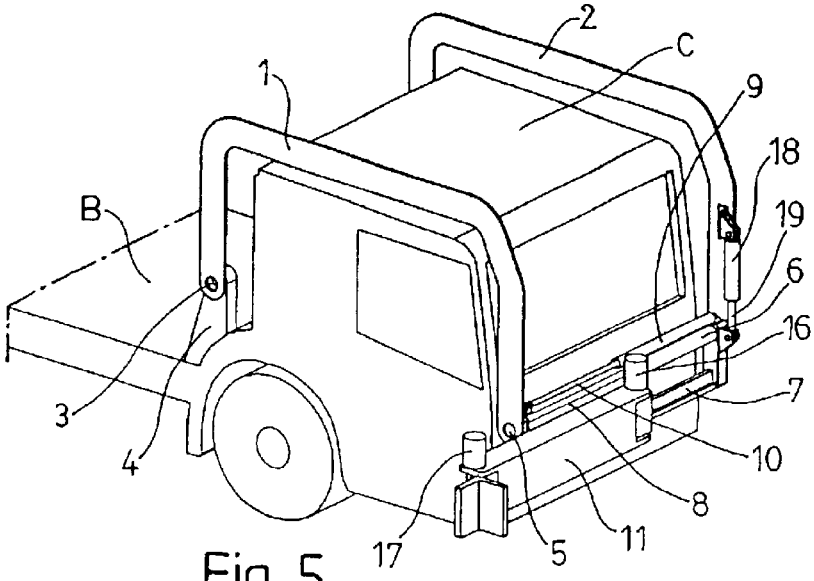
FIGS. 5 and 6 in a perspective view and in a plan-view respectively show the device being arranged to pick up a container being placed at the right-hand side.
Figure 6:
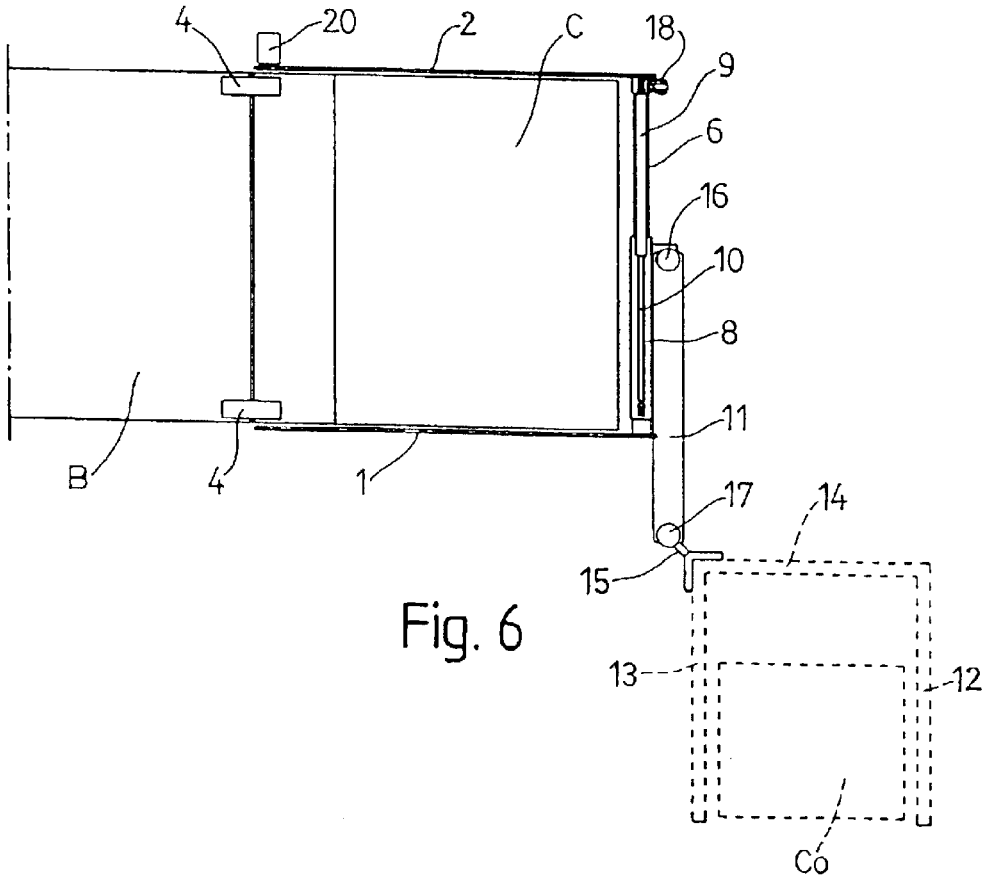
Figure 7:
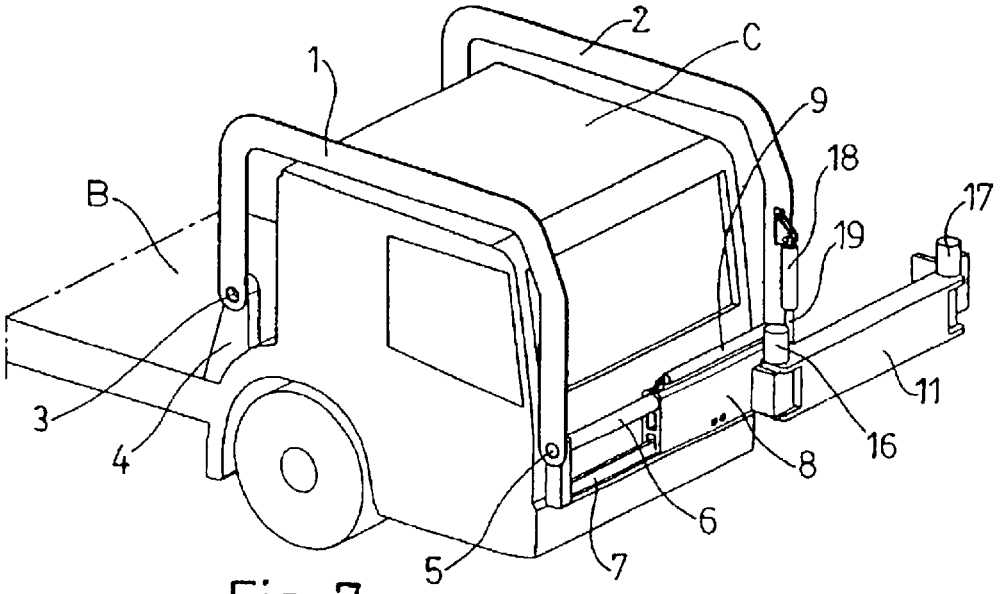
FIGS. 7 and 8 in a perspective view and in a plan-view respectively illustrate the device being arranged to pick up a container being placed at the left-hand side.
Figure 8:
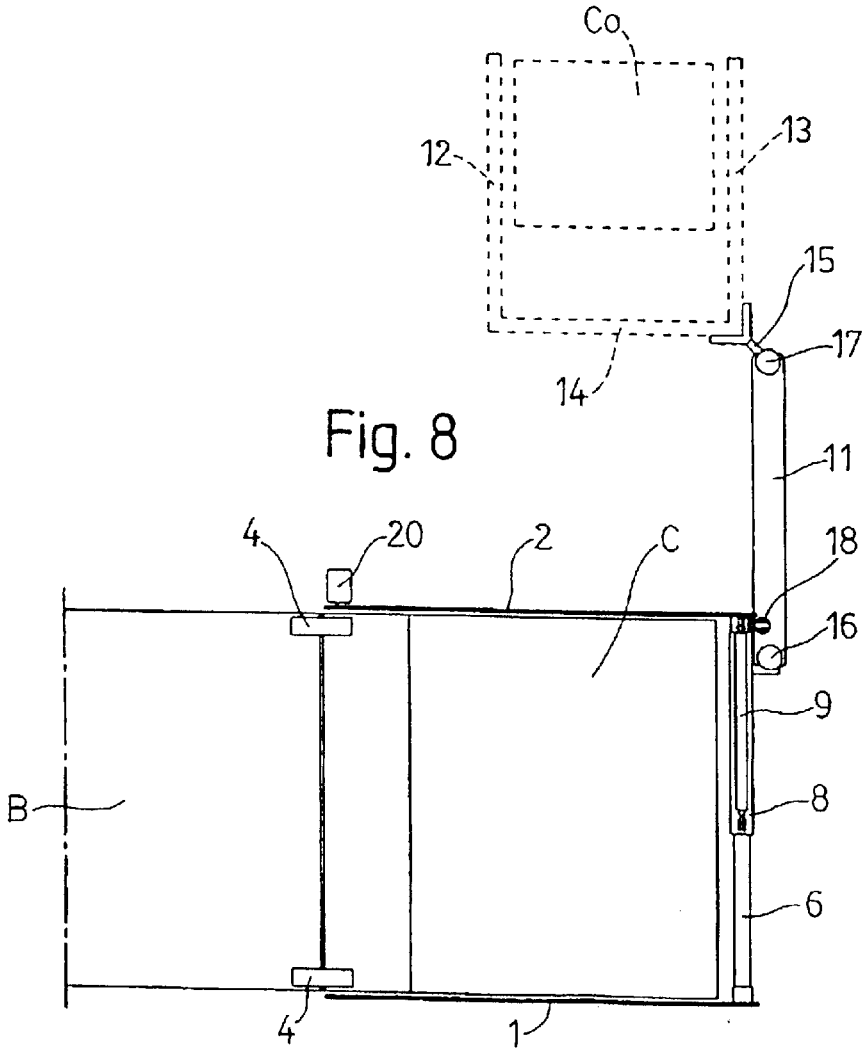
Figure 9:
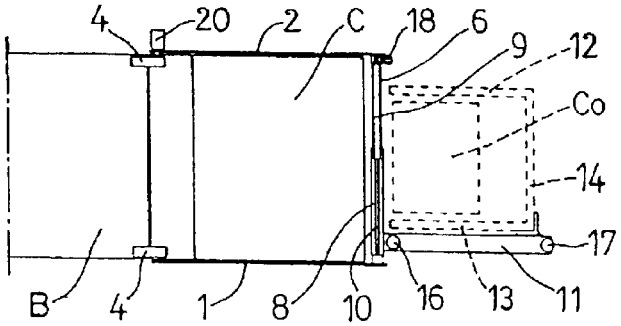
FIGS. 9 through 12 are respective plan-views showing this device with the arm being linked in a pin-jointed connection to the right end of the slide and being respectively arranged for a normal dumping operation, for an inverse dumping operation, for picking up a container being placed at the right-hand side, and for picking up a container being placed at the left-hand side.
Figure 10:
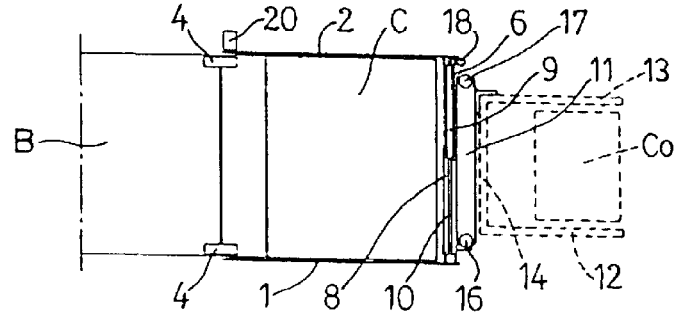
Figure 11:
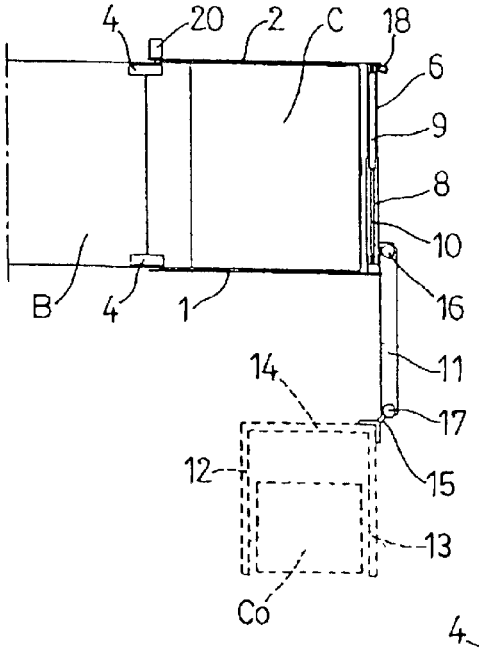
Figure 12:
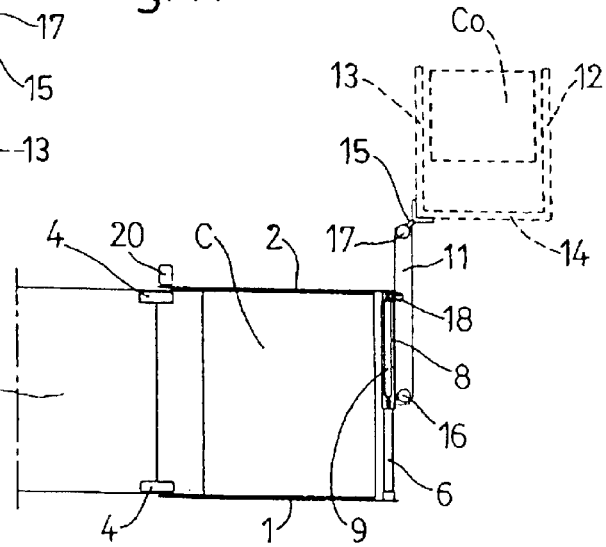
Figure 13:
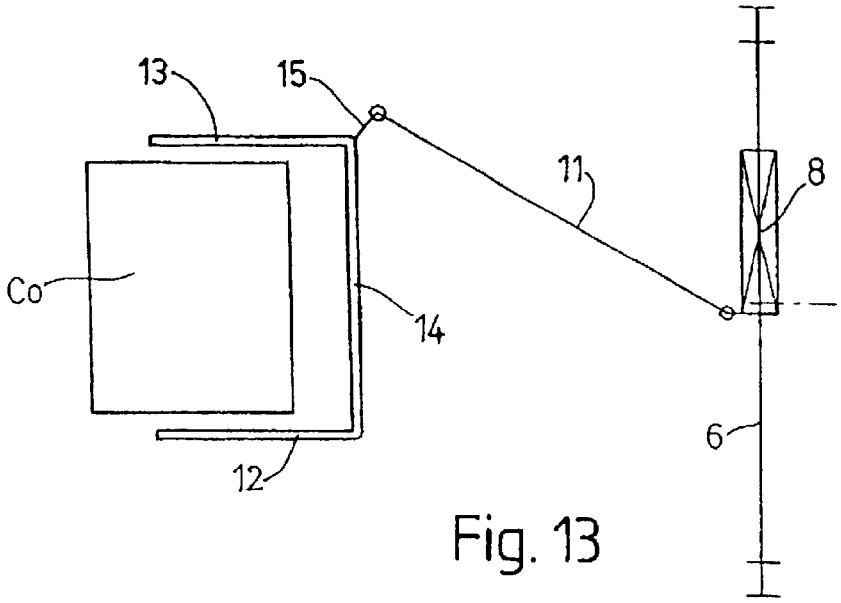
FIGS. 13 and 14 are diagrammed plan views respectively showing this device when frontally picking up a container and when picking up a container being obliquely placed with respect to the front of the truck.
Figure 14:
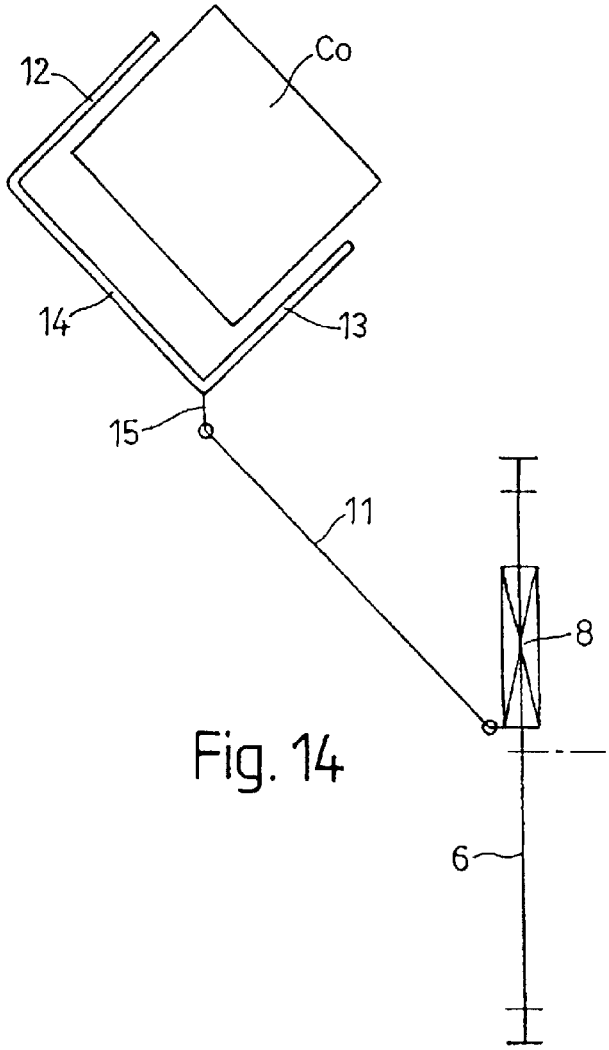

According to the drawings this device for picking up containers comprises two U-shaped holders 1 and 2 being arranged in an inverted-U, mutually parallel arrangement and at their rear end 3 being linked in a pin-jointed connection to a bracket 4 being provided on the truck frame B behind the cab C of said truck. A guide is linked in a pin-jointed connection to the front end 5 of these U-shaped holders and comprises a cylindrical top member 6 and a bottom member 7 having a cross-section in the shape of an inverted T.

A slide 8 is slidingly fitted to said guide and is actuated by means of a plunger 10 cooperating with a cylinder 9, said slide in its upper region surrounding the top member 6 of the guide and in its lower region being fitted to the bottom member 7 of said guide.

An arm 11 is linked in a pin-jointed connection to one of the ends of the slide 8 and has its other end linked in a pin-jointed connection to the lateral, rear region of the supports 12 and 13 by whose means the containers CO will be grabbed, said supports being interconnected with a cross member 14 thus forming a horizontal U arrangement, the pin-jointed connection of said arm at its front end being established with an appendage 15 being solidly attached to said supports being arranged in a U-shaped arrangement, said appendage being arranged in an obliquely diverging plane at 45° in the above-mentioned region of the supports.

At the pin-jointed connections being provided at the ends of the arm 11 driving means 16 and 17 have been provided in order to actuate this arm and the container grabbing supports.

The guide 6, 7 is in connection with one 2 of the U-shaped holders by means of a cylinder 18 cooperating with a plunger 19, said guide being thus tiltable at the front ends of said U-shaped holders, said tiltability in combination with the motion of said holders around their rear ends 3 being provided with a driving means 20 allowing to arrange the supports 12 and 13 at the height being adequate for grabbing the container CO.

Figure 16:
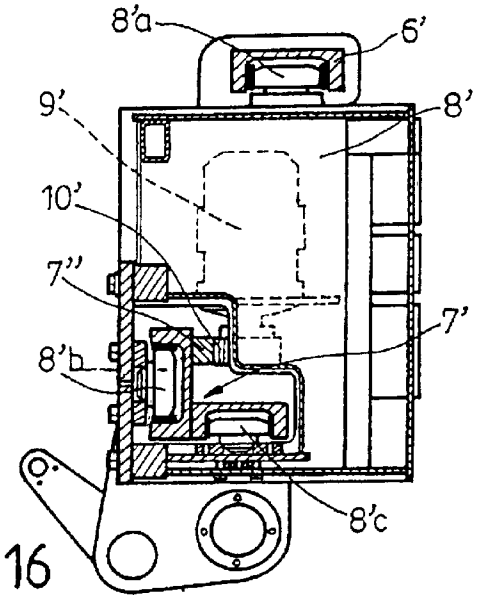
FIG. 16 in a sectional view as per section line XVI—XVI in FIG. 15 shows the assembly being formed by the guide and the slide.
Figure 15:
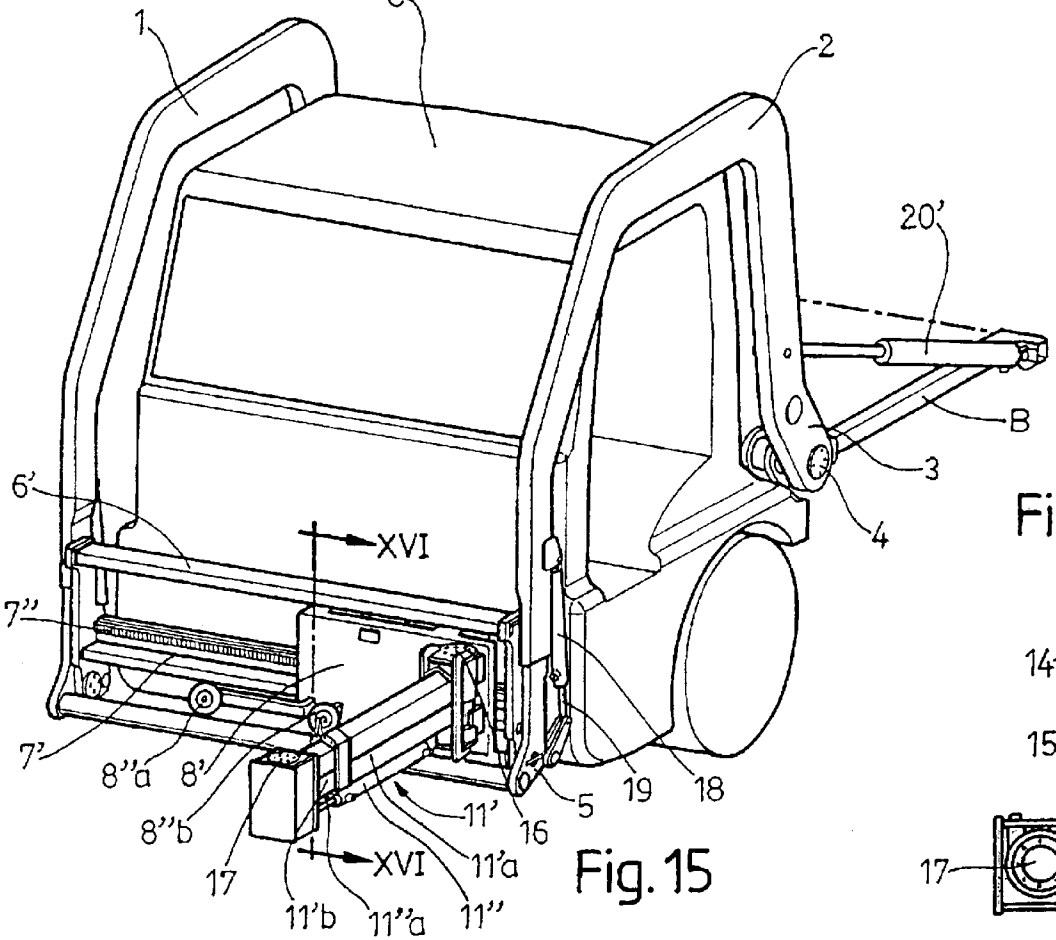
FIG. 15 is a perspective view illustrating this device with the telescopic arm and the slide being provided with runners and sucker pads.

According to FIGS. 15 and 16 a guide is linked in a pin-jointed connection to the front end 5 of the U-shaped holders, said guide comprising a top member 6' being formed by an inverted channel, and a bottom member 7' being formed by two channels being arranged in an angular arrangement.

A slide 8' is slidingly fitted to said guide and is actuated by means of a motor 9' being provided with a pinion 10' engaging a toothed rack 7" being provided on the bottom member 7' of the guide, said slide comprising runners 8'*a*, 8'*b* and 8'*c* being respectively arranged in the upper, lateral and lower regions of said slide and running along the concave sides of said channels forming the members 6' and 7' of said guide.

Figure 17:
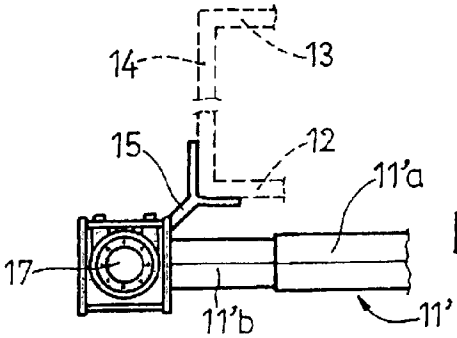
FIG. 17 is a plan-view showing the end of the telescopic arm being linked in a pin-jointed connection to the appendage being attached to the container grabbing assembly.

An arm 11' has one end linked in a pin-jointed connection to one of the ends of the slide 8', said arm being formed by two telescopic members 11'*a* and 11'*b* and having its other end linked in a pin-jointed connection to a lateral, rear region of the supports 12 and 13 serving to grab the containers, the pin-jointed connection of the front end of said arm 11' being established with the appendage 15 being solidly attached to said supports being arranged in a U-shaped arrangement (FIG. 17).

Each of the pin-jointed connections at the ends of the arm 11' has been provided with a respective driving means 16 and 17 for respectively actuating this arm and the container grabbing supports.

The member 11'*a* being part of the arm 11' will be provided with antifriction means to thus cooperate with member 11'*b* also integrating said arm, said antifriction means for example consisting in runners or pads of a self-lubricating nature. In order to be telescopically actuated said arm has been fitted with a cylinder 11" cooperating with a plunger 11"*a*.

The guide 6', 7' is in connection with one 2 of said U-shaped holders by means of the cylinder 18 cooperating with the plunger 19 in order to thus obtain the tiltability of said guide at the front ends of said U-shaped holders, said tiltability in combination with the motion of these holders around their rear ends 3 being provided with a driving means 20' allowing to arrange the supports 12 and 13 at the height being adequate for grabbing the container.

The slide 8' is frontally fitted with two sucker pads 8"*a* and 8"*b* for grabbing the containers.

What is claimed is:

1. A device for picking up and dumping or washing garbage containers on trucks, said device comprising two U-shaped holders being arranged in an inverted-U arrangement, having their respective rear ends linked in a pin-jointed connection to the truck and having fitted to their front ends a mechanism being provided with supports by means of which the containers are grabbed in order to be lifted and tipped; said device being characterised in that the supports form an assembly being at its lateral, rear region linked in a pin-jointed connection to the mechanism by means of an obliquely diverging appendage.

2. A device for picking up and dumping or washing garbage containers on trucks as per claim 1, characterised in that the appendage of the assembly being formed by the supports is situated in a plane being at 45° with respect to said assembly.

3. A device for picking up and dumping or washing garbage containers on trucks as per claim 1, characterised in that the appendage of the assembly being formed by the supports is linked in a pin-jointed connection to the end of an arm having its other end linked in a pin-jointed connection to a slide being apt to be slid along a guide being provided between the front ends of the U-shaped holders being arranged in an inverted-U arrangement.

4. A device for picking up and dumping or washing garbage containers on trucks as per claim 3, characterised in that said arm is linked in a pin-jointed connection to one of both end regions of the slide.

5. A device for picking up and dumping or washing garbage containers on trucks as per claim 3, characterised in that the guide is arranged in a tiltable arrangement between the U-shaped holders being arranged in an inverted-U arrangement.

6. A device for picking up and dumping or washing garbage containers on trucks as per claim 3, characterised in that the guide comprises two parallel members being arranged one above the other, the slide surrounding the top member and being fitted to the bottom member of the guide.

7. A device for picking up and dumping or washing garbage containers on trucks as per claim 3, characterised in that the arm is a telescopic arm.

8. A device for picking up and dumping or washing garbage containers on trucks as per claim 3, characterised in that the guide comprises an upper inverted channel and a lower assembly comprising two channels being arranged in an angular arrangement and having their concave sides arranged in such a way that they are respectively facing the lateral side and downwards, runners being fitted to the slide running in said channels.

9. A device for picking up and dumping or washing garbage containers on trucks as per claim 3, characterised in that the slide is frontally fitted with sucker pads for grabbing the containers.

* * * * *